US005491536A

United States Patent [19]

Mashiba et al.

[11] Patent Number: 5,491,536

[45] Date of Patent: Feb. 13, 1996

[54] IMAGE-QUALITY STABILIZER HAVING ADJUSTABLE TIME INTERVAL BETWEEN FEEDBACK CONTROL

[75] Inventors: Tamaki Mashiba, Nara; Akihiko Taniguchi, Yamatokoriyama, both of Japan

[73] Assignee: Sharp Kabushiki Kaisha, Osaka, Japan

[21] Appl. No.: 313,847

[22] Filed: Sep. 28, 1994

[30] Foreign Application Priority Data

Oct. 4, 1993 [JP] Japan ..... 5-248270

[51] Int. Cl.[6] ..... G03G 21/00

[52] U.S. Cl. ..... 355/208; 355/246

[58] Field of Search ..... 355/208, 214, 355/219, 246

[56] References Cited

U.S. PATENT DOCUMENTS

| | | | |
|---|---|---|---|
| 4,571,068 | 2/1986 | Tarumi et al. | 355/246 |
| 5,262,833 | 11/1993 | Fukushima et al. | 355/208 X |
| 5,369,473 | 11/1994 | Ogawa et al. | 355/214 |
| 5,394,251 | 2/1995 | Aikens | 355/208 X |
| 5,416,564 | 5/1995 | Thompson et al. | 355/208 |

FOREIGN PATENT DOCUMENTS

| | | |
|---|---|---|
| 2-97981 | 4/1990 | Japan . |
| 3-148675 | 6/1991 | Japan . |
| 3-255340 | 11/1991 | Japan . |

*Primary Examiner*—Robert Beatty

*Attorney, Agent, or Firm*—David G. Conlin; Brian L. Michaelis

[57] ABSTRACT

An image-quality stabilizer provided in a copying machine executes a feedback control on a charger output based on an adhering toner amount detected by a patch sensor in a pre-rotation of the photoreceptor drum directly before each copying operation is started. A time interval between feedback controls is counted by a timer, and a CPU sets an appropriate time interval in accordance with an amount of change in the adhering toner amount detected by the patch sensor or in accordance with the charger output before and after feedback control. According to the described arrangement, since the feedback control is executed at a timing set in accordance with the amount of change in adhering toner, variations in image quality such as an increase in image density caused by overcompensation and an excessive feedback control can be prevented, thereby ensuring stable image quality by efficiently compensating the image density without increasing an amount of toner consumption.

8 Claims, 8 Drawing Sheets

IMAGE-QUALITY STABILIZER HAVING ADJUSTABLE TIME INTERVAL BETWEEN FEEDBACK CONTROL

FIELD OF THE INVENTION

The present invention relates to an image-quality stabilizer for use in an electrophotographic printing machine such as an analog copying machine, a digital copying machine, a laser beam printer, etc., for controlling image forming devices so as to maintain the density of toner adhering to the circumference of a photoreceptor in a desirable range.

BACKGROUND OF THE INVENTION

In an electrophotographic printing machine such as a copying machine, a laser printer, etc., image forming processes are generally carried out in the following manner. By exposing an image formed on a document, toner is made to adhere to an electrostatic latent image formed on a photoreceptor, and after transferring the toner to a transfer sheet, the toner is melted with the application of heat so as to be permanently affixed thereto, thereby forming an image (copying). In such an electrophotographic printing machine, as the above-mentioned image forming process is repeated, the respective properties of the image forming devices including expendables such as a photoreceptor, a developer material, etc., and of a charger deteriorate, and for this reason, a surface potential of the photoreceptor and an amount of toner adhering thereto change which cause variations in copy density and copy brightness, thereby presenting the problem of unstable image quality.

In order to prevent the above problem, the conventional electrophotographic printing machine is provided with an image-quality stabilizer for detecting an amount of toner adhering to the surface of the photoreceptor or a surface potential which affects the amount of adhering toner. This, in turn, executes a feedback control on the image forming devices including a charger, a developer unit, a discharge lamp, and an exposure optical system so as to obtain a constant detected value. More specifically, the image-quality stabilizer executes feedback-controls on the image forming devices so as to stabilize the image quality. Therefore, an image forming device obtained at a reasonable price can be used and an expensive image forming device whose property can be ensured against the repetitive use is not needed. Moreover, an exchange cycle of the expendables such as the developer, etc., can be made longer. Therefore, the described arrangement offers an electrophotographic printing machine which ensures stable image quality at a reasonable price and a low running cost. The feedback control is executed for example, when the electrophotographic printing machine is installed or when the main switch of the machine is turned ON. For example, by executing the feedback control in the pre-rotation of the photoreceptor at the initial start of the copying operation and during subsequent copying operations, the copy density and the copy brightness can be controlled in respective desirable ranges, thereby producing copies with stable image quality.

However, even if unstable image quality ascribable to changes in properties of the image forming devices against the repetitive use can be prevented, if, for example, the image forming device obtained at a reasonable price shows a substantial temperature dependency, and the surface potential of the photoreceptor and the amount of toner adhering thereto change as in the previously described case, variations in copy density and copy brightness occur. Thus, the described arrangement does not give a solution to the problem of unstable image quality. More specifically, the copy density (image density) and the temperature in the copying machine have the following relationship as shown in FIG. 9. At low temperature, the copy density becomes low, while at high temperature, the copy density becomes high as the charging ability of the photoreceptor changes according to the temperature in the copying machine. The variations in copy density can be maintained in a desirable range as long as the charger output is fixed at 400 V, and the temperature in the copying machine is set at 40° C. However, when the temperature of the copying machine changes, the copy density may not be maintained within the desirable range.

In the copying machine provided with image forming devices which have temperature dependencies, if a copying operation is repeated without executing the feedback control on the image forming devices, the temperature in the copying machine may be changed by switching it OFF and ON. According to this change in temperature, the copying density also changes as shown in FIG. 5. At room temperature (20° C.), after the power switch is turned ON, the temperature in the copying machine is heated to 40° C. in about 1.5 hours and according to this temperature rise, the copy density increases to 30%. More specifically, in accordance with the relationship between the copy density and the temperature in the copying machine shown in FIG. 9, when the power switch is turned ON, the temperature in the copying machine is equal to the room temperature (20° C.), and the copy density is 24%, and in 0.5 hours, the temperature in the copying machine is heated to 30° C. and the copy density increases to 27% and falls in an appropriate range of the copy density. Further, when 1.5 hours has passed after the power switch is turned ON, the temperature in the copying machine is heated to 40° C., and the copy density increases to 30%. Namely, when the copying machine is in the OFF state, the temperature in the copying machine is low, and even after the power switch is turned ON, the temperature of the photoreceptor remains low for a while, and thus the copy density is outside the appropriate range, i.e., lower than the appropriate copy density. Thereafter, the temperature in the copying machine is heated by a heat source such as a thermal fuser provided in the copying machine, etc., and accordingly the copying density finally falls within the appropriate density.

In the case where the appropriate copy density range is set to 27–33%, after the power switch is turned ON again, an inadequate image having a low copy density is formed for the first 0.5 hours of operation.

This lowering of the copy density ascribable to the temperature dependency may be prevented, for example, by the following applications:

(1) adopting image forming devices and expendables which show desirable temperature dependencies;

(2) providing a temperature stabilizer in the electrophotographic printing machine; or (3) setting a greater permissible range for the image quality characteristic.

However, none of the above techniques prevents the copy density from decreasing because of the following problems.

Namely, in the method (1), the high stabilizing characteristic for the expendables, etc., are required, and a high cost is required. The respective properties of the desired expendables, image forming devices, etc., may not be ensured.

In the method (2), a temperature detector may be required, or a warmer is required for the photoreceptor, and thus the problems of high cost and an increase in power consumption are presented.

In the method (3), the copy density cannot be maintained efficiently, the amount of toner is likely to be excessive or insufficient, and the expendables cannot be used efficiently for a long time.

Therefore, in the conventional copying machine, the feedback control is executed in order to compensate for the changes in the properties of the photoreceptor, the image forming devices as they deteriorate at a predetermined timing set based on time that the copying machine is not in use or the copy count number, etc., so as to prevent unstable image quality ascribable to changes in temperature.

Since the copy density changes gradually as the photoreceptor or the image forming devices, etc., deteriorate, this problem, ascribable to changes in temperature, can be prevented by executing the feedback control at an appropriate timing.

However, even when the copying machine provided with the described image-quality stabilizer is used, if the feedback control is not executed at an appropriate timing, the following problems would occur.

Namely, in the case where each interval between feedback controls is set long, and the next feedback control is not carried out at a desirable time interval as shown in FIG. 10, the photoreceptor is heated after the first feedback control which is to be executed when the power switch is turned ON, and the surface potential increases, and the copying machine is overcompensated. Ascribable to the increase in the copy density, variations in the image quality occur, thereby presenting the problem of increasing an amount of toner consumption as denoted by the slashed area in the figure.

On the other hand, when an interval between feedback controls is set short as shown in FIG. 11, the feedback control is frequently carried out even after the copy density is stabilized. Therefore, although the copy density can be maintained within the desirable range, the problem of increasing the toner consumption occurs. In figures, $T_1$ and $T_3$ satisfy $T_1<T_3$, wherein $T_1$ and $T_3$ may be set at 0.25 hours and 0.75 hours respectively.

SUMMARY OF THE INVENTION

An object of the present invention is to provide an image-quality stabilizer for use in an electrophotographic printing machine, which ensures stable image quality with an efficient compensation of copy density by preventing variations in image quality caused by an increase in copy density ascribable to overcompensation, an excessive feedback control and an increase in toner consumption.

In order to achieve the above objective, the image stabilizer for use in the electrophotographic printing machine of the present invention is characterized by comprising:

- adhering toner amount detecting means for detecting an adhering toner amount of a reference toner image formed on a photoreceptor;
- time measuring means for measuring a set time interval between feedback controls;
- time interval altering means for altering the set time interval based on a difference between a detected adhering toner amount and a predetermined reference toner amount at a start of every feedback control; and
- control means for executing a feedback control on an output from charger means based on an altered time interval, so that the detected adhering toner amount becomes equal to the predetermined reference toner amount.

According to the above arrangement, the time interval altering means alters the time interval between feedback controls based on the difference between the adhering toner amount detected by the adhering toner amount detecting means and a predetermined reference toner amount. Further, based on the altered time interval, the control means executes a feedback control on an output from the charger so that the detected adhering toner amount becomes equal to the reference toner amount. According to the above arrangement of the electrophotographic printing machine provided with image forming devices which show temperature dependencies, a desirable image quality can be ensured by executing the feedback control at an appropriate timing before the image quality deteriorates by predicting the deterioration of the image quality ascribable to changes in temperature. Therefore, the electrophotographic printing machine ensures stable image quality with an efficient compensation of copy density by preventing variations in image quality caused by, for example, an increase in copy density ascribable to overcompensation, an excessive feedback control and an increase in toner consumption.

The image-stabilizer for use in an electrophotographic printing machine in accordance with the present invention is also characterized by further comprising time interval reducing means for setting a shorter time interval based on the table when a difference between the detected adhering toner amount and the reference toner amount is above a predetermined value. In addition to the described effects achieved by the above arrangement, the following effect can be achieved: even if, for some reason, a sudden change occurs in an amount of toner which has been changed constantly and gradually, the image quality is compensated so as to obtain an appropriate image quality.

For a fuller understanding of the nature and advantages of the invention, reference should be made to the ensuing detailed description taken in conjunction with the accompanying drawings.

DESCRIPTION OF THE EMBODIMENTS

[EMBODIMENT 1]

The following description discusses one embodiment of the present invention with reference to FIGS. 1–6.

Figure 2:
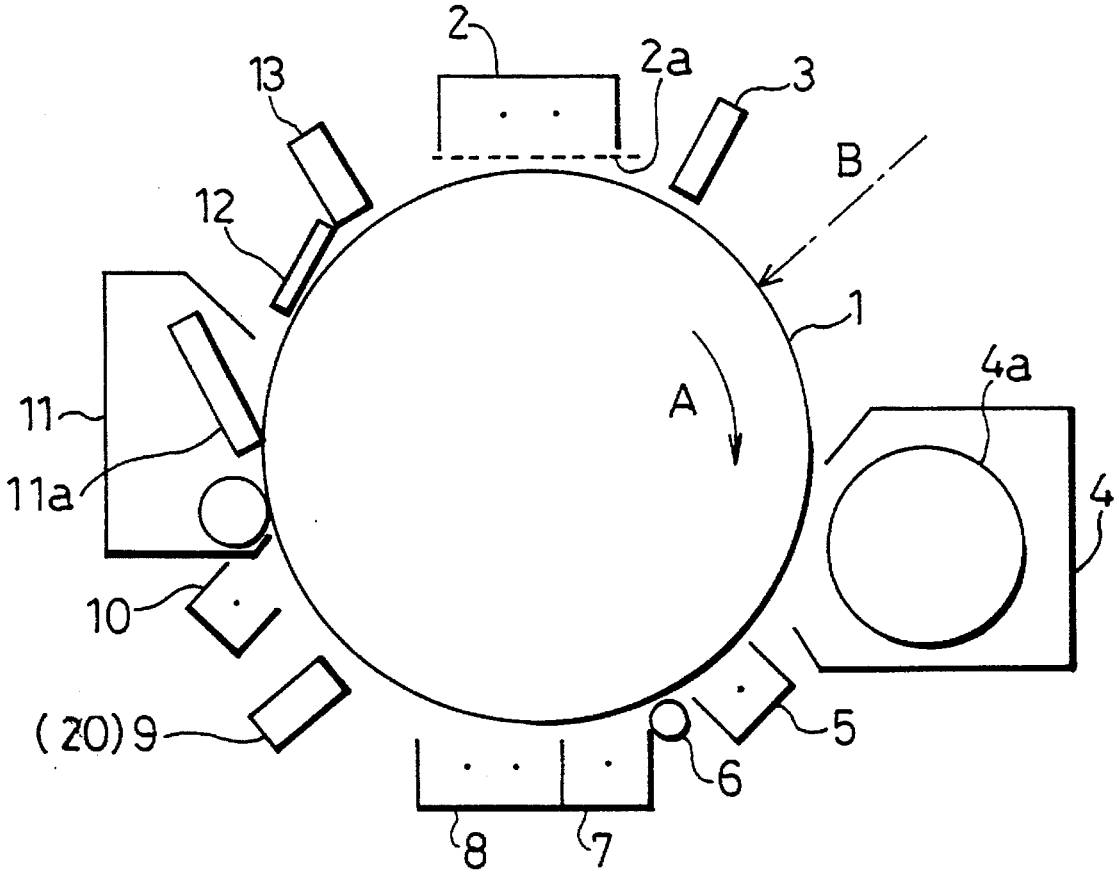
FIG. 2 is a depiction of the structure of the copying machine including the control system in FIG. 1.

As illustrated in FIG. 2, a copying machine as an electrophotographic printing machine provided with an image-quality stabilizer of the present embodiment includes a cylindrical photoreceptor drum 1 (photoreceptor). The photoreceptor drum 1 is arranged so as to rotate in the direction of A in the copying machine. When light is projected from a copy lamp (not shown) provided in an exposure optical system (not shown) to a document (not shown), the light is reflected from the document. Then, the reflected light is applied to a document image from the direction of B, thereby forming an electrostatic latent image.

A scorotron type charger 2 (image forming device) for charging the photoreceptor drum 1 is situated right above the photoreceptor drum 1. The charger 2 has a grid electrode 2*a*, and its output is controlled by controlling a grid voltage to be applied to the grid electrode 2*a*.

Disposed around the photoreceptor drum 1 as other image forming devices are a blank lamp 3, a developer unit 4, a pre-transfer charger 5, a pre-transfer lamp 6, a transfer device 7, a separating device 8, a patch sensor 9 (toner amount detecting means), a pre-cleaning charger 10, a cleaning device 11, a discharge lamp 12 and a fatigue lamp 13.

The blank lamp 3 is mainly composed of LEDs (Light Emitting Diodes) and is provided for projecting light onto a non-image area of the photoreceptor drum 1.

The developer unit 4 is provided therein with a magnet roller 4*a*. The magnet roller 4*a* includes a cylindrical non-magnetic sleeve which forms a peripheral portion thereof and also includes therein magnetic poles. The sleeve is arranged so as to be rotated by a rotation driving force from a driving source (not shown). The magnetic roller 4*a* produces a magnetic brush by making the developer attracted to the sleeve using the magnetic forces from the magnetic poles. The developer is supplied to the photoreceptor drum 1 by rotating the sleeve.

The pre-transfer charger 5 removes the charges which form the electrostatic latent image on the photoreceptor drum 1 by the corona discharging using an opposite polarity to that of the charger 2, i.e., the same polarity as the toner before transferring the toner attracted to the electrostatic latent image to a transfer sheet by the developer unit 4. As a result, the attraction exerted from the toner to the photoreceptor drum 1 is weakened. The pre-transfer lamp 6 removes the charges which form the electrostatic latent image by projecting light on the photoreceptor drum 1 so as to weaken the attraction exerted from the toner to the photoreceptor drum 1.

The transfer device 7 transfers the toner image formed on the photoreceptor drum 1 to the transfer sheet by the corona discharger having the same polarity as the charger 2. The separating device 8 applies an a.c. corona discharge to the transfer sheet having a toner image transferred thereonto so as to weaken the attraction exerted from the toner to the photoreceptor drum 1. As a result, the transfer sheet is separated from the photoreceptor drum 1.

In the image forming process after the described separation process, the transfer sheet having the toner image transferred thereonto is transported to a fusing device (not shown) where heat and pressure are applied, thereby making the toner image on the transfer sheet to be permanently affixed thereto.

The patch sensor 9 is composed of a light emitting diode, a photo-transistor, etc. The patch sensor 9 carries out a feedback control (to be described later) on a charger output in pursuit of stable image quality in the following manner. Light is projected from the LEDs onto a dark toner patch formed on the photoreceptor drum 1, and light reflected from the photoreceptor drum 1 is received by the photo-transistor. Then, the patch sensor 9 detects a received amount of light indicating an amount of toner adhering to the photoreceptor drum 1, and outputs a detected value in the form of an electric signal.

The pre-cleaning charger 10 removes unwanted charges remaining on the photoreceptor drum 1 by applying thereto charges, having opposite polarity to the charger 2, to the photoreceptor drum 1, and weakens the attraction exerted from the residual toner to the photoreceptor drum 1. The cleaning device 11 includes a blade 11*a* and removes the toner from the surface of the photoreceptor drum 1 by scraping and collecting the toner adhering to the photoreceptor drum 1 using the blade 11*a*.

By projecting light onto the photoreceptor drum 1, the discharge lamp 12 removes charges on the photoreceptor drum 1 remaining after the cleaning process. By projecting light different from the discharge lamp 12, the fatigue lamp 13 removes charges that still remain on the photoreceptor drum 1 by projecting light different from the discharge lamp 12. The fatigue lamp 13 also applies light-induced fatigue to a predetermined degree to the photoreceptor drum, so as to prevent the copy density from being changed by a series of copying operation including the above-mentioned image forming process.

Figure 1:
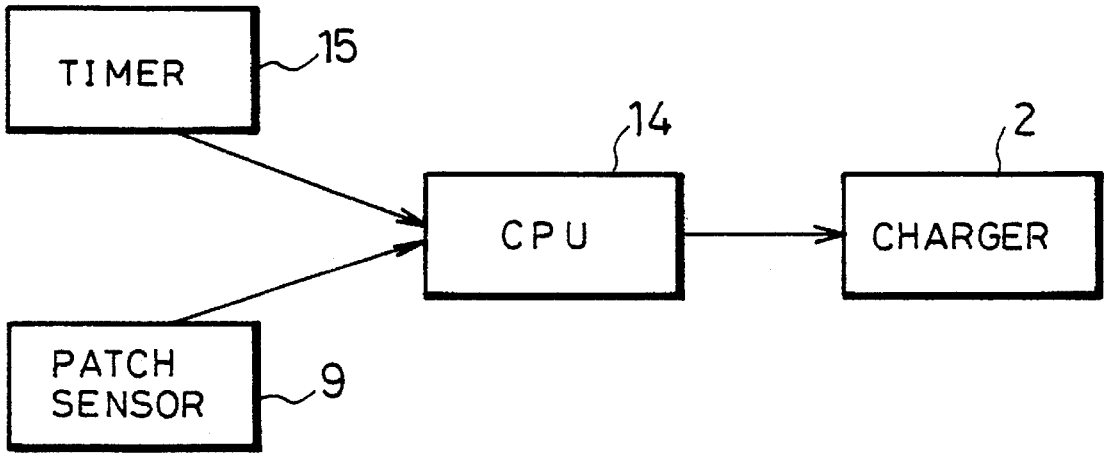
FIG. 1 is a block diagram illustrating a structure of the control system of a copying machine including an image-quality stabilizer in accordance with embodiments 1 through 4 of the present invention

As illustrated in FIG. 1, the copying machine of the present embodiment includes a CPU (Central Processing Unit) 14 for carrying out the feedback control on the charger output from the charger 2 based on an output from the patch sensor 9 which detects the adhering toner amount of the dark toner patch formed on the photoreceptor drum 1 in the manner to be described later. The CPU 14 includes a memory device (not shown). The memory device stores therein a reference value used in executing feedback control on the charger output. This reference value is set beforehand in an initialization state such as when the copying machine is assembled in a factory or when the copying machine is installed. Further, an interval timer (hereinafter referred to as a timer) 15 is connected to the CPU 14 of the copying machine main body, for counting a time interval until the next feedback control is executed. The CPU 14 alters the value to be set in the timer based on a relationship (to be described later) and sets at which the feedback control is executed. Namely, the CPU 14 is provided with a function as time interval altering means.

The following description discusses each process for controlling the charger output.

The above-mentioned dark toner patch is formed on the photoreceptor drum 1 in a predetermined shape by charging the photoreceptor drum 1 to a predetermined potential by the charger 2 and making the photoreceptor drum 1 pass through the developer unit 4. The amount of toner forming the dark toner patch is detected by the patch sensor 9. The CPU 14 compares a predetermined reference value and the value detected by the patch sensor 9, and executes the feedback control on the charger output so that the detected value becomes equal to the reference value.

Figure 3:
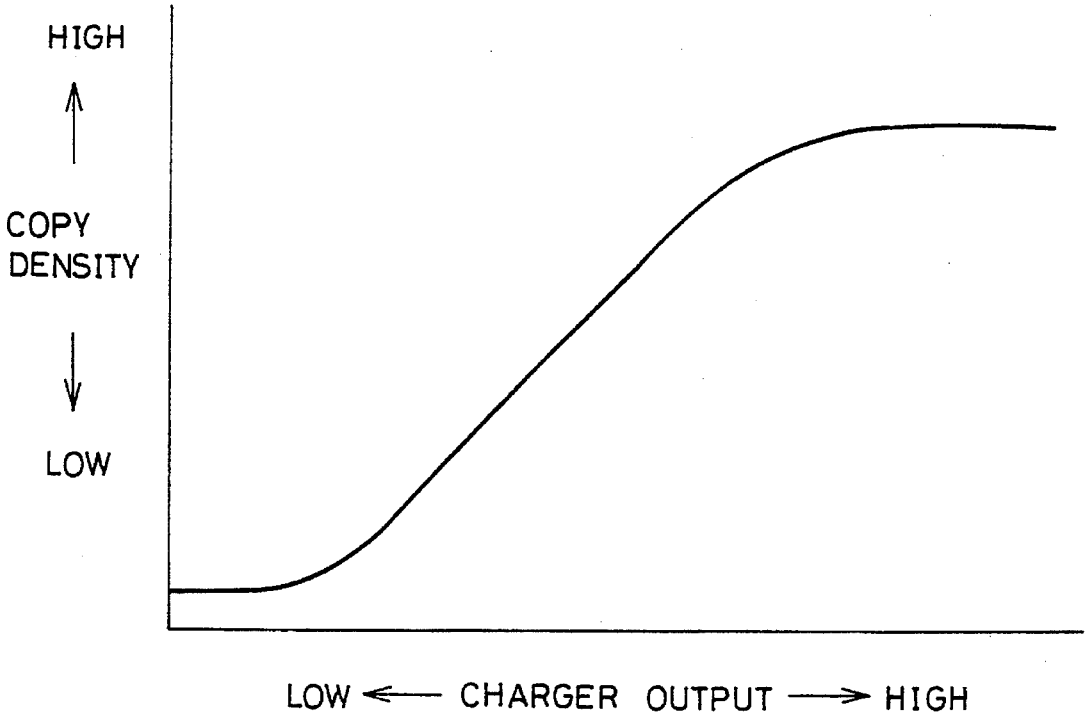
FIG. 3 is a graph showing the relationship between charger outputs and copy densities.

As illustrated in FIG. 3, the charger output and the copy density have such a relationship that the copy density increases as the charger output becomes higher. Therefore, when the copy density decreases after the power switch is turned OFF, the charger output is controlled and raised. Thus, even if the cause of changing the copy density is not known, the copy density can be appropriately compensated by executing the feedback control on the charger output based on the amount of toner adhering to the surface of the photoreceptor drum 1 detected by the patch sensor 9.

After described image compensation process, i.e., the feedback control, changes in the condition of the photoreceptor drum 1 and the condition under which the developing operation is carried out may occur, due to, for example, a temperature rise in the copying machine or changes in temperature around the copying machine (room temperature). Therefore, if the copying operation continues in the described state, the copying machine would be overcompensated which results in an excessively high copy density. This increase in the temperature in the copying machine and variations in copy density ascribable to changes in temperature in the copy machine are predictable in accordance with a predetermined relationship.

Figure 4:
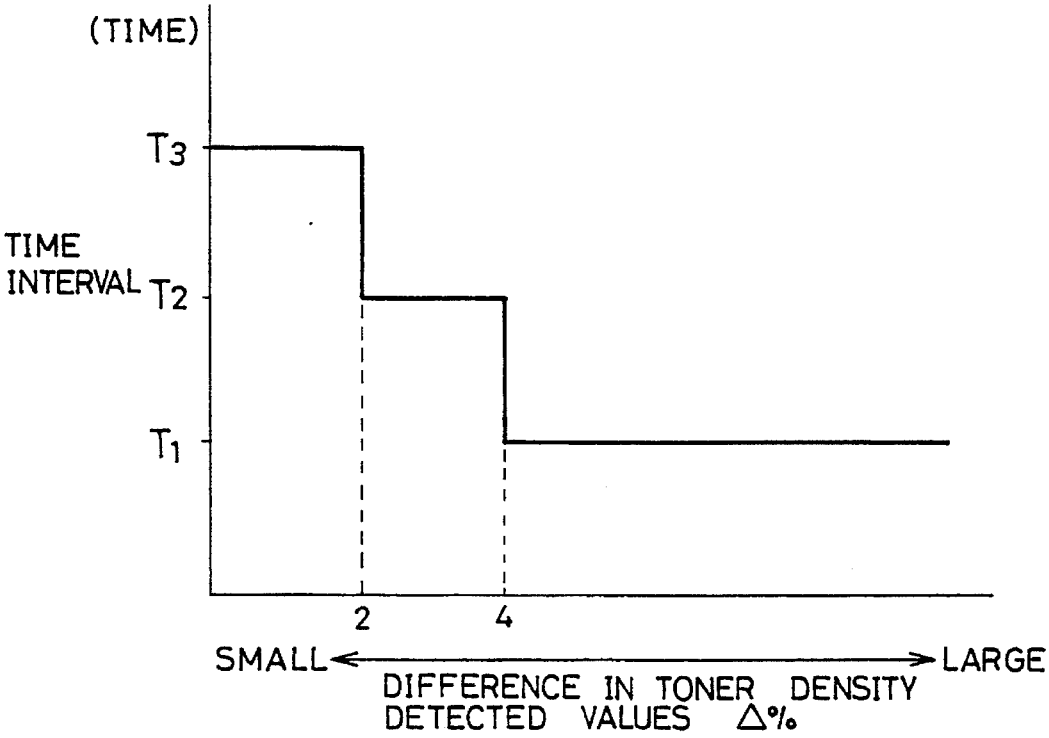
FIG. 4 is a graph showing the time interval for the next feedback control, which is to be computed based on a difference between a reference value for the feedback control and an adhering toner amount.

In order to prevent the described situation where the copying operation is carried out with the state of overcompensation, as shown in FIG. 4, the memory device of the present embodiment stores therein a graph showing time intervals set in accordance with toner density difference, i.e., a difference between the adhering toner amount detected by the patch sensor before the feedback control is started and the reference value stored in the memory device. The CPU 14 executes the feedback control based on the relationship between the charger output and the copy density shown in FIG. 3 at the obtained time interval.

More specifically, the CPU 14 computes a difference between the adhering toner amount detected at the start of the feedback control by the patch sensor 9 and the reference value stored in the memory device, and reads out the time interval in accordance with the computed value (toner density difference) from the time interval setting table of Table 1 prepared based on the relationship shown in FIG. 4. Then, when an instruction indicating the completion of the feedback control is given, the time interval thus readout is set in the timer 15, and the time interval is observed using the timer 15, and when a signal indicating that the set time has elapsed, the next feedback control is executed.

Before variations occur in the image quality ascribable to changes in copy density caused by an increase in temperature in the copying machine or changes in temperature around the copying machine, the copy density can be readjusted by altering the charger output from the output which would cause covercompensation. Here, time intervals $T_1$, $T_2$ and $T_3$ shown in FIG. 4 and Table 1 satisfy the following relationship: $T_1<T_2<T_3$. The respective time intervals $T_1$, $T_2$ and $T_3$ may be set for example as follows: $T_1$=0.25 hours, $T_2$=0.5 hours, and $T_3$=0.75 hours.

TABLE 1

| Difference in Toner Density | Time Interval |
|---|---|
| 4% or above | $T_1$ |
| 2–4% | $T_2$ |
| below 2% | $T_3$ |

Figure 5:
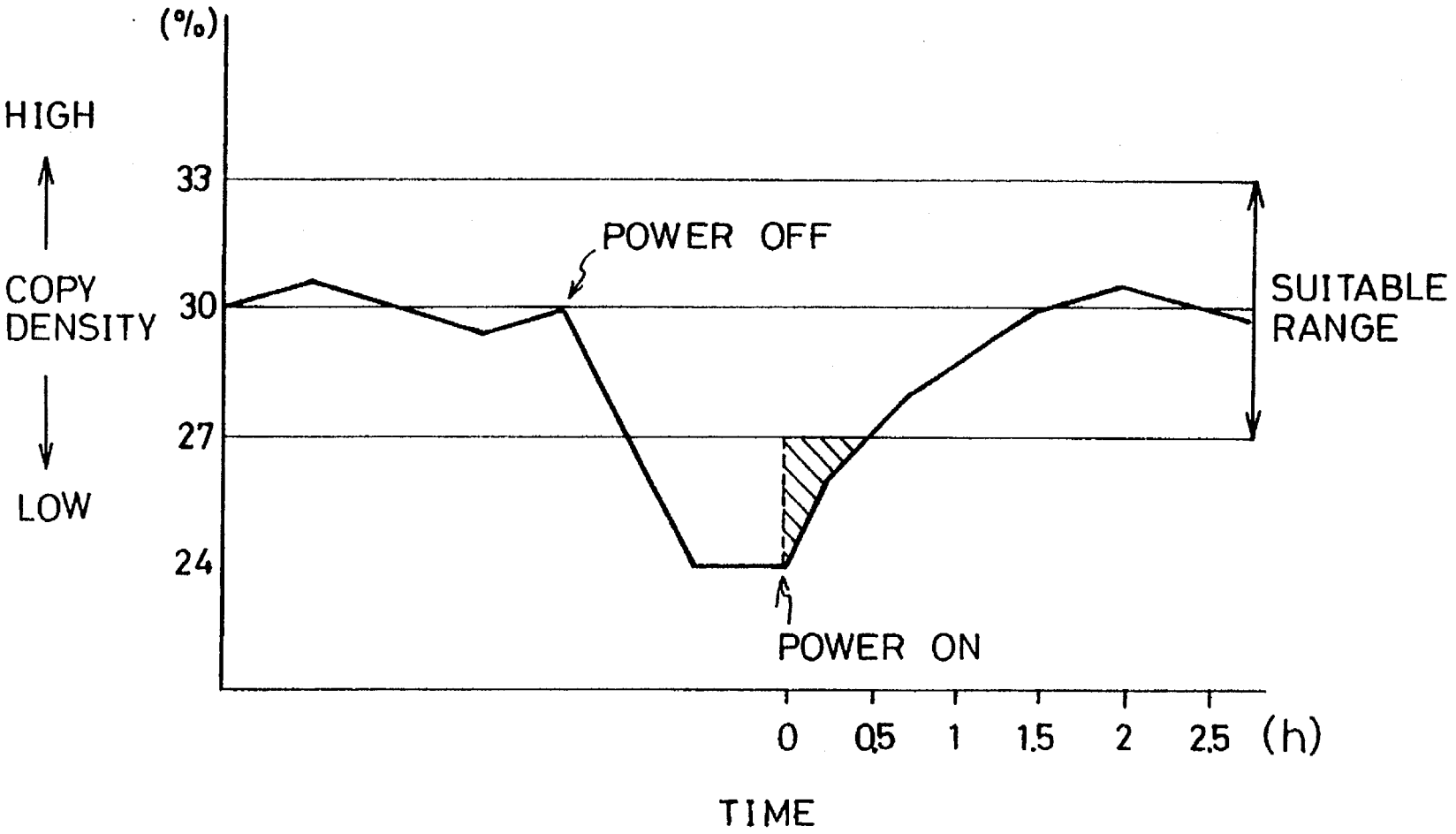
FIG. 5 is a graph showing variations in copy density between the state where the photoreceptor drum provided in the copying machine in FIG. 2 is being operated and the state where the photoreceptor drum is switched OFF.
Figure 6:
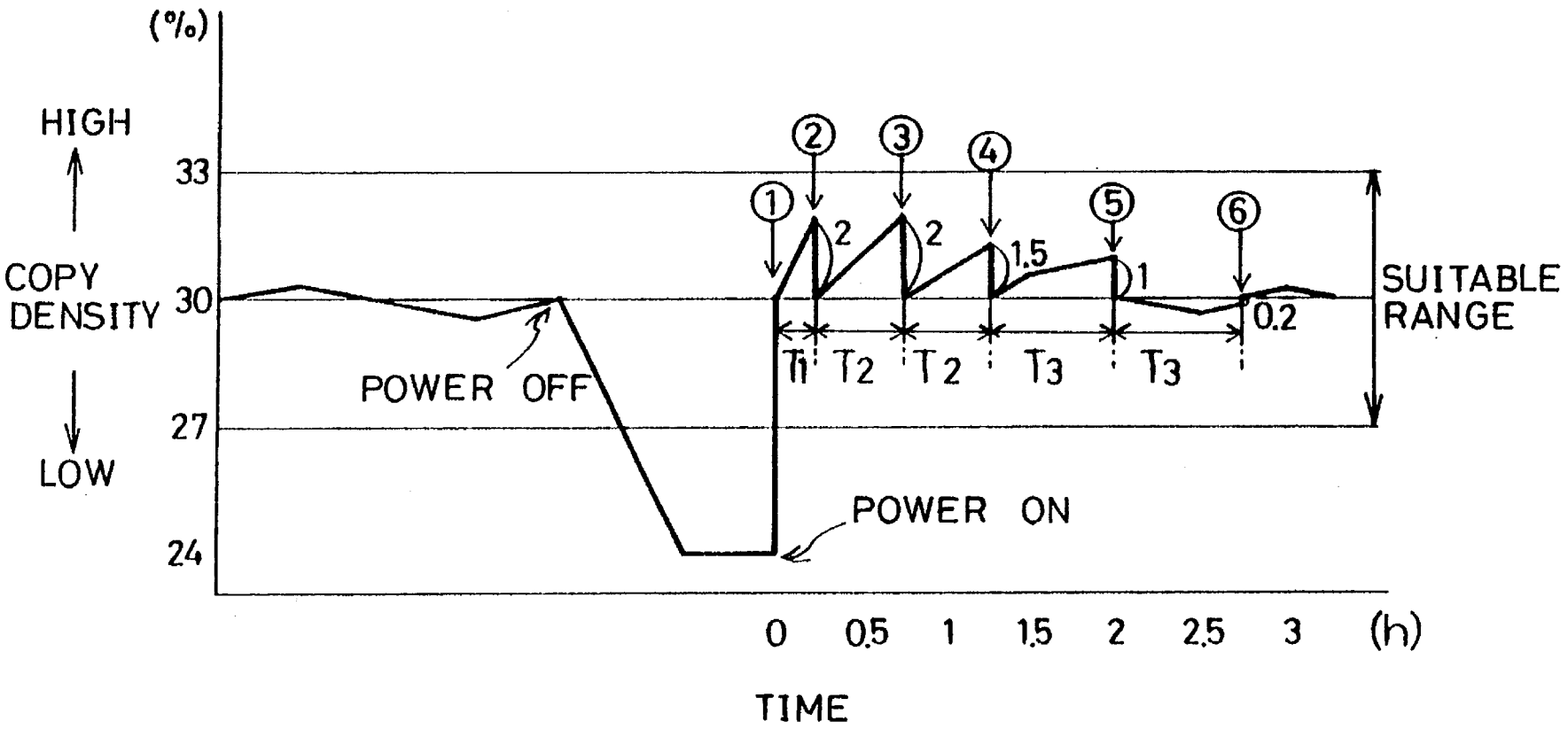
FIG. 6 is a graph showing variations in copy density when a feedback control is executed in the copying machine in FIG. 2 at a time interval obtained from the graph in FIG. 4.

As described, in the copying machine of the present embodiment, by compensating the image quality at an appropriate timing obtained the time interval setting table (Table 1), copy density changes as shown in FIG. 6 in accordance with the following changes in the state of the copying machine: power source ON→ power source OFF→ power source ON, while without the compensation of the image quality, the copy density changes as shown in FIG. 5. In this case, execution of time, elapsed of time, difference in toner density and time interval are as shown in Table 2.

TABLE 2

| Execution Time | Time Elapsed | Difference in Toner Density | Time Interval |
|---|---|---|---|
| (1) | — | 6% | $T_1$ |
| (2) | $T_1$ | 2% | $T_2$ |
| (3) | $T_2$ | 2% | $T_2$ |
| (4) | $T_2$ | 1.5% | $T_3$ |
| (5) | $T_3$ | 1% | $T_3$ |
| (6) | $T_3$ | 0.2% | $T_3$ |

When the power switch is turned ON in the execution time (1), the first feedback control is carried out. Here, the reference toner density is set at 30%, and the compensation of +6% is applied so as to change the toner density from 24% to 30%. From this compensation of +6%, the time interval $T_1$ is obtained from the the time interval setting table. Accordingly, the timer 15 is set so that the second feedback control is executed after the time interval $T_1$ has elapsed. When the timer 15 finished counting the set time interval $T_1$, the second feedback control is executed in the execution time (2). Here, the compensation of −2% is applied so as to change the toner density from 32% to 30%. From this compensation of −2%, the time interval $T_2$ is obtained for the third feedback control. Accordingly, the timer 15 is set so that the third feedback control is executed after the time interval $T_2$ has elapsed. When the timer 15 finished counting the set time interval, the third feedback control is executed in the execution time (3). Thereafter, the feedback controls are executed in the execution times (3), (4) and (5) at respective time intervals in the described manner.

As a result, as shown in FIG. 6, after the feedback control is executed on the charger output based on an amount of adhering toner in the dark toner patch in the execution time (1), even when the copying machine is overcompensated ascribable to changes in temperature in the copying machine and the temperature around the copying machine, which would cause an increase in copy density, overcompensation can be prevented using timer by executing the next feedback control at an appropriate timing.

As described, by executing the feedback control at an appropriate timing, changes in copy density caused by the deterioration of the photoreceptor drum 1 and changes in the temperature in and around the copying machine can be accurately adjusted, and the variations in image quality caused by an increase in copy density ascribable to overcompensation can be prevented without requiring a special detector or stabilizer. Moreover, the image density can be compensated efficiently by preventing unnecessary and excessive feedback control, thereby ensuring a stable image quality without increasing the amount of toner consumption.

[EMBODIMENT 2]

The following description discusses another embodiment of the present invention with reference to FIGS. 1, 2 and 4. For convenience in explanations, members having the same function as the previous embodiment will be designated by the same reference numerals, and thus the descriptions thereof shall be omitted here.

As illustrated in FIG. 2, a copying machine as an electrophotographic printing machine provided with an image-stabilizer of the present embodiment has a photoreceptor drum 1, image forming devices including a charger 2, etc., placed along the circumference of the photoreceptor drum 1. The copying machine also includes a CPU for compensating image quality by executing a feedback control on an output from the charger 2 based on an output from a patch sensor 9, and an interval timer 15, etc., as illustrated in FIG. 1. Therefore, the arrangement of the copying machine is the same as the previous embodiment, and the feedback control for stabilizing the image quality is executed in the same manner as the previous embodiment.

However, in the copying machine of the present embodiment, a time interval setting table stored in a memory device (not shown) of the CPU 14 is as shown in Table 3, while in the previous embodiment, the time interval setting table is as shown in Table 1 in accordance with the graph in FIG. 4. The difference is that in Table 3, even with the same difference in toner density, the time interval changes according to the number of times the feedback control is executed.

TABLE 3

| Difference in Toner Density | second time | third time | fourth time | fifth time |
|---|---|---|---|---|
| 4% or above | $T_1$ | $T_2$ | $T_3$ | $T_3$ |
| 2–4% | $T_2$ | $T_3$ | $T_3$ | $T_3$ |
| below 2% | $T_3$ | $T_3$ | $T_3$ | $T_3$ |

In the case where the difference in toner density obtained after carrying out the further feedback control is large, the feedback control is executed at a shorter time interval based on the time interval setting table in Table 3. Namely, the CPU 14 of the present embodiment is provided with a function as the time interval reducing means.

For example, when the difference in toner density increases from the range of 2–4% to the range of 4%, the time interval is set at $T_1$ from the column of 4% or above and the low of next time in Table 3. Accordingly, the subsequent time intervals are set at $T_2$, $T_3$ and $T_3$ in this order. Similarly, when the difference in toner density increases from the range of below 2% to the range of 2–4%, the time interval is set at $T_2$ from the column 2–4% and the low of the next time of Table 3. Accordingly, the subsequent time intervals are set at $T_3$, $T_3$ and $T_3$. Namely, it is arranged such that when an increase in the difference in toner density occurs, the next time interval is set from the column of the corresponding difference in toner density and the low of the next time irrespectively of the number of times the feedback control having been carried out.

Therefore, in a normal operation, even if unexpected change occurs in copy density which has been changed constantly and gradually, the influence can be minimized.

[EMBODIMENT 3]

The following description discusses still another embodiment of the present invention with reference to FIGS. 1 and 2 and FIGS. 4–7: For convenience in explanations, members having the same function as the previous embodiments will be designated by the same reference numerals, and thus the descriptions thereof shall be omitted here.

As illustrated in FIG. 2, a copying machine as an electrophotographic printing machine provided with an image-quality stabilizer of the present embodiment has a photoreceptor drum 1, image forming devices including a charger 2, etc., placed along the circumference of the photoreceptor drum 1. The copying machine is also provided with a CPU for adjusting an image quality by applying a feedback control to a charger output from the charger 2 based on an output from a patch sensor 9, and an interval timer 15, etc., as illustrated in FIG. 1. Therefore, the arrangement of the copying machine is the same as the previous embodiment, and in the copying machine of the present embodiment, the time interval is set based on a graph in FIG. 4 as in the case of the previous embodiment.

However, the differences between the present embodiment and the previous embodiment lie in the following. In the previous embodiment, only a single dark toner patch is formed, while in the present embodiment, it is set beforehand such that charger outputs of two different levels for example, 400 V and 500 V are obtained and accordingly two dark toner patches are formed, and respective amounts of toner adhering thereto are detected by the patch sensor 9. Further, in the CPU 14, values detected by the patch sensor 9 are compared with reference values set beforehand, and output values are predicted so that the detected values becomes equal to the respective reference values.

Figure 7:
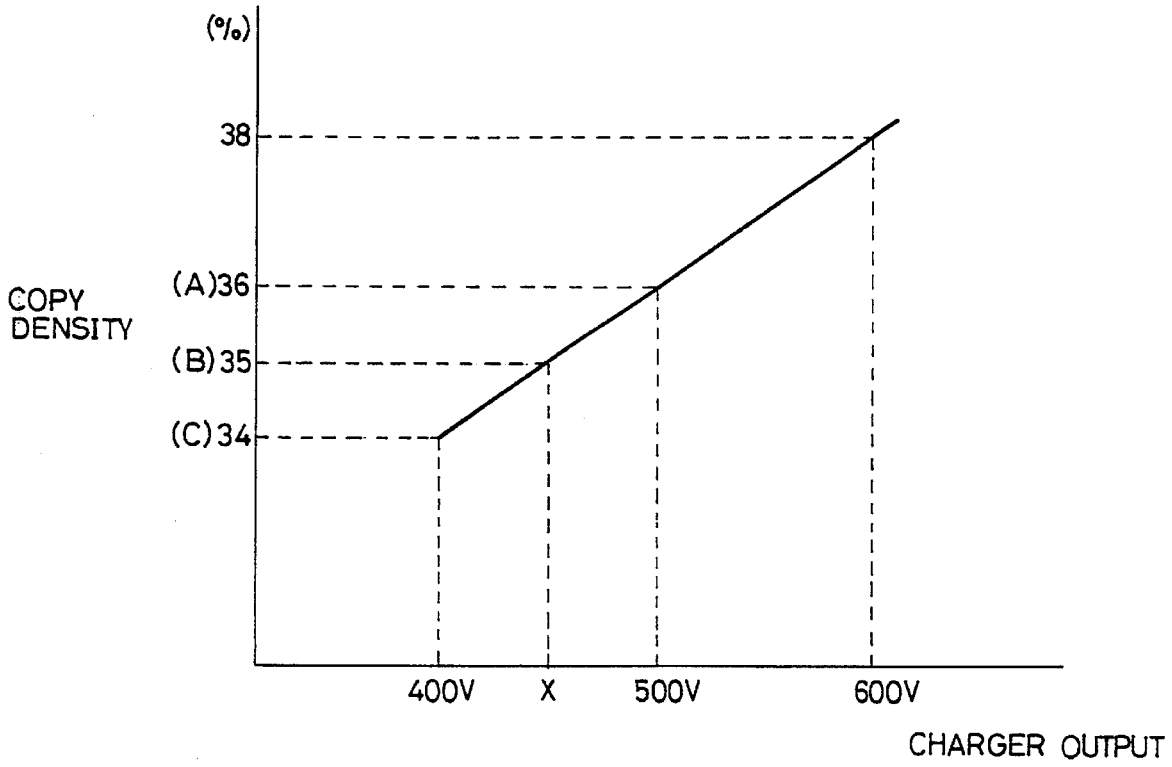
FIG. 7 is a graph showing the relationship between charger outputs and copy densities in a certain range.

As shown in FIG. 7, the charger output and the copy density have a proportional relationship in a certain range. Therefore, if it is known that the charger output is 400 V at the copy density of 34%, and the charger output is 500 V at the copy density of 36%, the charger output X at the copy density of 35% can be obtained without actually measuring the density. This reference value is set beforehand in an initialization state such as when the copying machine is assembled in a factory or when the copying machine is installed, and the reference value is stored in a memory device (not shown) connected to the CPU as in the case of the previous embodiment.

In the copying machine of the present embodiment, a feedback control is executed based on a time interval computed by the CPU 14 as in the case of the previous embodiment. With this feedback control, even if the copying machine is overcompensated ascribable to changes in and around the copying machine after the feedback control is executed on the charger output based on the amount of toner adhering to the dark toner patch, and the copy density increases, the next feedback control is executed at an appropriate timing so that the overcompensation can be prevented using the timer 15, and thus the next copying operation can be started at an appropriate density, thereby preventing an increase in an amount of toner consumption.

As described, by executing the feedback control at an appropriate timing, changes in copy density caused by the deterioration of the photoreceptor drum 1 and changes in temperature in and around the copying machine can be accurately adjusted, and variations in image quality caused by an increase in image density ascribable to overcompensation can be prevented without requiring a special detector or stabilizer. Moreover, unnecessary and excessive feedback control can be prevented and the image density can be efficiently overcompensated, thereby ensuring stable image quality without increasing the amount of toner consumption.

In the described arrangements 1, 2 and 3, a change in the amount of adhering toner is computed by comparing a reference value set beforehand when forwarding the copying machine from the factory or when it is installed with a value detected by the toner amount detecting means. According to the described arrangement, it is not necessary to measure the amount of adhering toner after the feedback control is executed, and thus the arrangement offers a prompt density adjustment. Moreover, unlike the conventional arrangement, for example, a memory for storing the adhering toner amount in the previous feedback controls can be eliminated, and it is required to store only the reference value set in the initialization state when the copying machine is forwarded from the factory or when it is installed. Moreover, the change in the amount of adhering toner, ascribable to the temperature characteristic can be predicted irrespectively of the differences in the image forming devices including the photoreceptor drum 1, the charger 2, etc. By comparing it with the reference value, and thus an efficient output from the charger 2 is not required.

[EMBODIMENT 4]

The following description discusses still another embodiment of the present invention with reference to FIGS. 1, 2, 7 and 8. For convenience in explanations, members having the same functions as the previous embodiments will be designated by the same reference numerals, and thus the descriptions thereof shall be omitted here.

As illustrated in FIG. 2, a copying machine as an electrophotographic printing machine provided with an image-quality stabilizer of the present embodiment is provided with a photoreceptor drum 1, image forming devices including a charger 2, etc., placed along the circumference of the photoreceptor drum 1. The copying machine is also provided with a CPU for adjusting an image quality by applying a feedback control to a charger output from the charger 2 based on an output from a patch sensor 9, and an interval timer 15, etc., as illustrated in FIG. 1. Therefore, the arrangement of the copying machine is almost the same as embodiment 3, and the feedback control for stabilizing the image quality is executed in the similar manner to that of embodiment 3.

In the embodiment 3, an amount of adhering toner is detected based on the detected value of the patch sensor 9. In the copying machine of the present embodiment, however, a charger output which determines the adhering toner amount is detected.

After the image quality is compensated, i.e., after the feedback control is executed, changes in the condition of the photoreceptor drum 1 and the condition under which the developing operation is executed may occur due to a temperature rise in the copying machine or changes in the environmental temperature of the copying machine (room temperature). Therefore, if the copying operation continues in the described state, the copying machine would be overcompensated and the copy density would be excessively high. The described variations in copy density caused by an increase in the temperature in the copying machine and changes in the temperature around the copying machine can be predicted based on a certain relationship.

Figure 8:
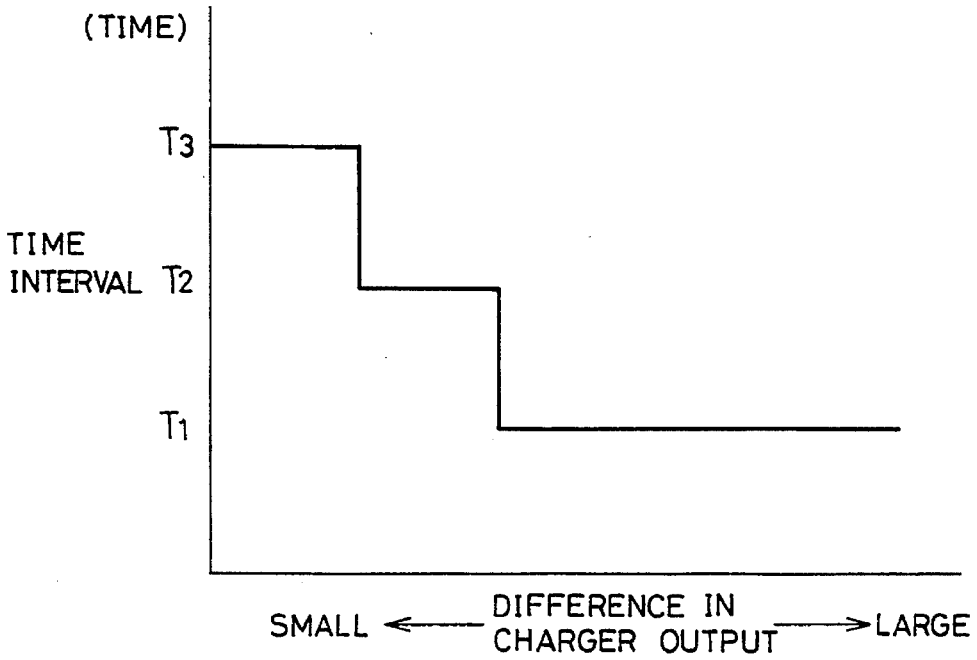
FIG. 8 is a graph showing the time interval for the next feedback control, which is to be computed based on the difference from the previous charger output in carrying out the feedback control.
Figure 9:
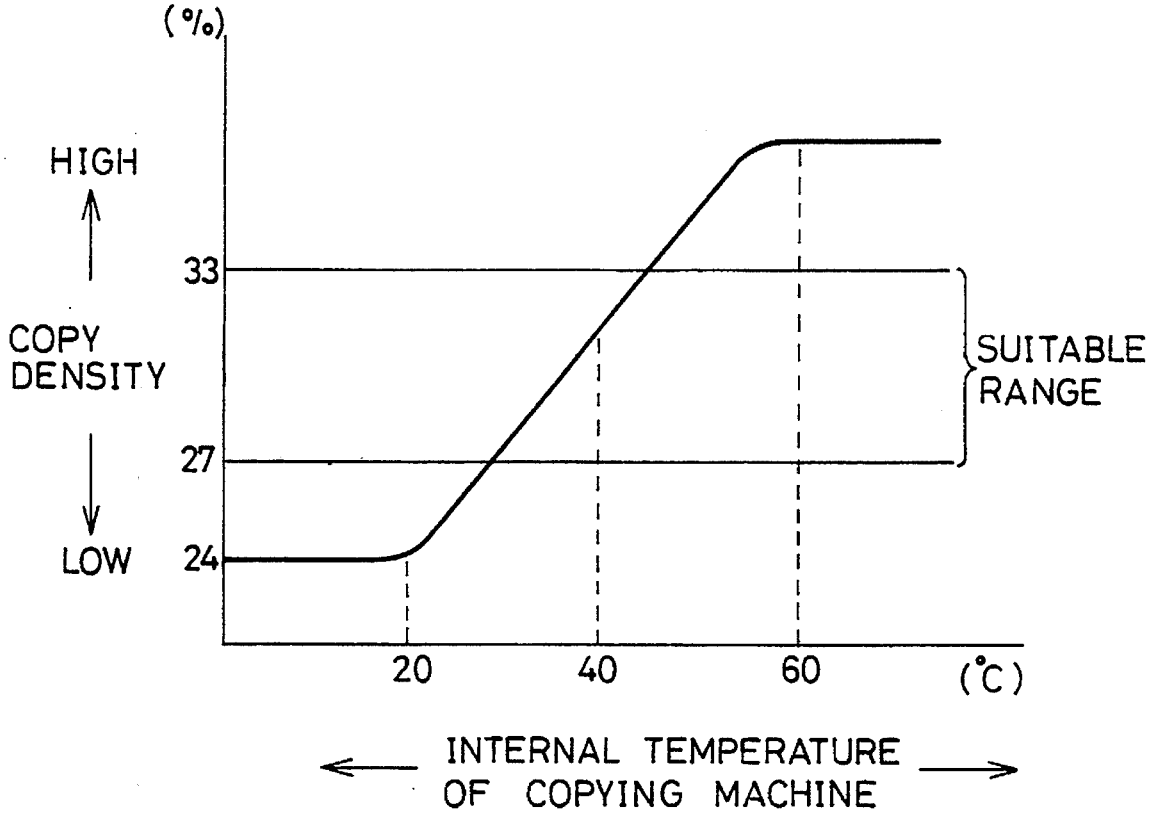
FIG. 9 is a graph showing the relationship between temperature in the copying machine and the copy density.
Figure 10:
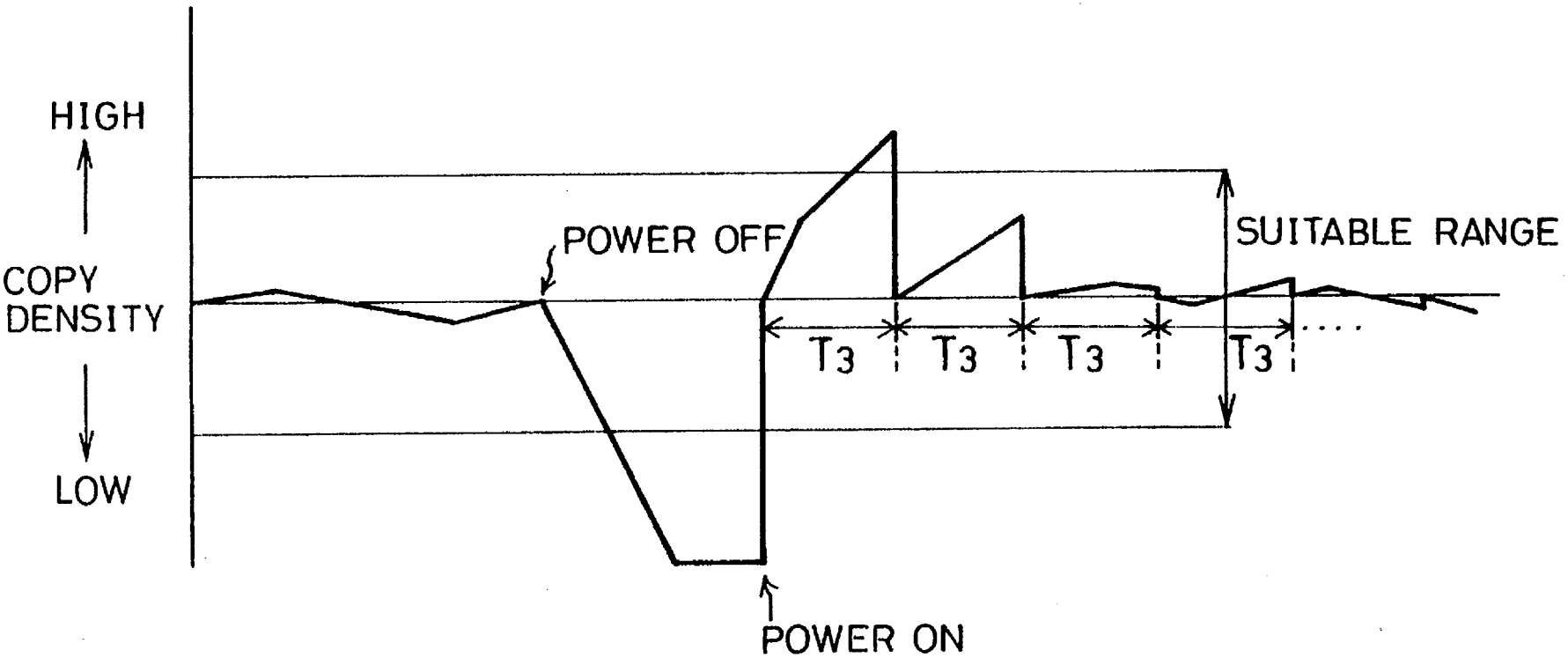
FIG. 10 is a graph showing variations in copy density in the case where a feedback control is executed in the copying machine in FIG. 2 at a long time interval.
Figure 11:
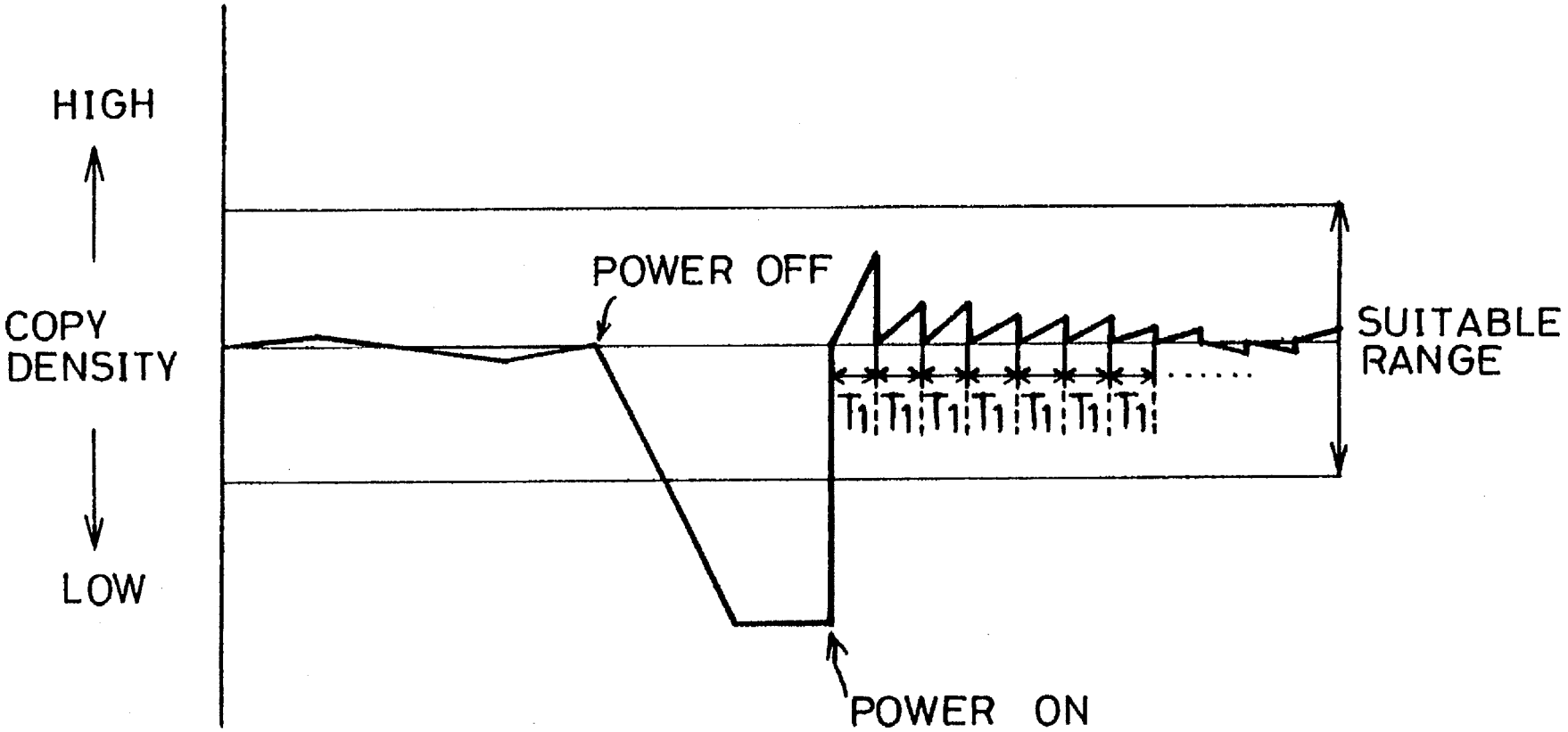
FIG. 11 is a graph showing variations in copy density in the case where a feedback control is applied to the copying machine in FIG. 2 at a short time interval.

In order to prevent the described situation where the copying operation continues in the overcompensated state, the memory device of the present embodiment stores a graph showing time intervals computed based on a difference between a charger output which determines the copy density at the start of the feedback control and a charger output which determines the copy density at the end of the feedback control as shown in FIG. 8. The CPU 14 performs the feedback control based on the relationship between the charger output and the copy density shown in FIG. 7 at an obtained time interval.

More specifically, the CPU 14 computes a difference between a charger output which determines the copy density at the start of the feedback control and a charger output which determines the copy density at the end of the feedback control. The CPU 14 reads out the time interval corresponding to the computed value from the time interval setting table (Table 4) prepared based on the relationship shown in FIG. 8, and when an instruction indicating the image compensation process is completed is given, the time interval thus readout is set in the timer 15, and the time interval is measured by the timer. When a signal is output indicating the set time interval has elapsed, the next feedback control is executed. According to the above arrangement, before the quality of the copied image deteriorates due to an increase in temperature of the copying machine changes in temperature around the copying machine, the copy density can be readjusted by altering the charger output which would cause overcompensation. Here, the time intervals $T_1$, $T_2$ and $T_3$ satisfy the following relationship: $T_1<T_2<T_3$. The respective time intervals $T_1$, $T_2$ and $T_3$ may be set for example as follows: $T_1$=0.25 hours, $T_2$=0.5 hours and $T_3$=0.75 hours.

TABLE 4

| Difference in Charger Output | Time Interval |
|---|---|
| 4% or above | $T_1$ |
| 2–4% | $T_2$ |
| below 2% | $T_3$ |

As described, in the copying machine of the present embodiment, by compensating the image quality at an appropriate timing set based on the time interval setting table of Table 4, copy density changes as shown in FIG. 6 in accordance with the following changes in the state of the copying machine: power source ON→ power source OFF→ power source 0N, while without the compensation of the image quality, the copy density changes as shown in FIG. 5. In this case, execution of time, elapsed of time, differences in the charger output and time interval are as shown in Table 5.

TABLE 5

| Execution Time | Time Elapsed | Difference in Toner Density | Time Interval |
|---|---|---|---|
| (1) | — | 6% | $T_1$ |
| (2) | $T_1$ | 2% | $T_2$ |
| (3) | $T_2$ | 2% | $T_2$ |
| (4) | $T_2$ | 1.5% | $T_3$ |
| (5) | $T_3$ | 1% | $T_3$ |
| (6) | $T_3$ | 0.2% | $T_3$ |

As a result, as shown in FIG. 6, after the feedback control is applied to the charger output based on an amount of adhering toner in a dark toner patch in the execution time (1), even in the case where the copying machine is overcompensated due to changes in temperature in and around the copying machine, which would cause an increase in copy density, overcompensation can be prevented using the timer 15 by executing the next feedback control at an appropriate timing. Therefore, the next copying operation can be performed with a desirable copy density, and an increase in the toner consumption can be avoided.

For the time interval setting table stored in the memory device (not shown) in the CPU 14 may be as shown in Table 6 in replace of Table 4. In Table 6, even with the same difference in charger output, the time interval is altered according to the number of times the feedback control is executed.

TABLE 6

| Difference in Charger Output | second time | third time | fourth time | fifth time |
|---|---|---|---|---|
| 4% or above | $T_1$ | $T_2$ | $T_3$ | $T_3$ |
| 2–4% | $T_2$ | $T_3$ | $T_3$ | $T_3$ |
| below 2% | $T_3$ | $T_3$ | $T_3$ | $T_3$ |

In the case where the difference in the charger output obtained after carrying out the further feedback control is large, the next feedback control is carried out at a shorter time interval set based on the Table (Table 6). Namely, the CPU 14 of the present embodiment has a function as the time interval reducing means.

For example, when the difference in toner density increases from the range of 2–4% to the range of 4%, the time interval is set at $T_1$ from the column of 4% or above and the low of next time in Table 3. Accordingly, the subsequent time intervals are set at $T_2$, $T_3$ and $T_3$ in this order. Similarly, when the difference in charger output increases from the range of below 2% to the range of 2–4%, the time interval is set at $T_2$ from the column 2–4% and the low of the next time of Table 3. Accordingly, the subsequent time intervals are set at $T_3$, $T_3$ and $T_3$. Namely, it is arranged such that when an increase in the difference in charger output occurs, the next time interval is set from the column of the corresponding difference in toner density and the low of the next time irrespectively of the number of times the feedback control having been carried out.

Therefore, in a normal operation, even if an unexpected change occurs in copy density, the influence can be minimized.

As described, by carrying out the feedback control at an appropriate timing, without requiring a special detector or stabilizer, variations in copy density ascribable to changes in the temperature in and around the copying machine caused by the deterioration of the property of the photoreceptor 1, the copying machine can be compensated efficiently, and variations in image quality caused by an increase in image density ascribable to overcompensation can be prevented. Thus, the apparatus ensures stable image quality with an efficient compensation of the image density by preventing the problem of an excessive feedback control and an increase in toner consumption.

Moreover, since the amount of change in the adhering toner is computed by comparing the charger output value set in accordance with the amount of adhering toner when carrying out the previous feedback control and the charger output value set in accordance with the amount of adhering toner for the present feedback control, the amount of adhering toner after carrying out the feedback control is not needed to be measured, thereby achieving a prompt density compensation.

The invention being thus described, it will be obvious that the same way be varied in many ways. Such variations are not to be regarded as a departure from the spirit and scope of the invention, and all such modifications as would be obvious to one skilled in the art are intended to be included within the scope of the following claims.

What is claimed is:

1. An image quality stabilizer for use in an electrophotographic printing machine, comprising:

adhering toner amount detecting means for detecting an amount of adhering toner of a reference toner image formed on a photoreceptor;

time measuring means for measuring a set time interval between feedback controls;

time interval altering means for altering the set time interval based on a difference between a detected adhering toner amount and a predetermined reference toner amount at a start of every feedback control; and control means for executing a feedback control on an output from charger means based on an altered time interval, so that the detected adhering toner amount becomes equal to the predetermined reference toner amount.

2. The image-quality stabilizer as set forth in claim 1, wherein:

said time interval altering means includes a table showing time intervals, a time interval being set so as to be altered based on a difference between the detected adhering toner amount and the predetermined reference toner amount, and said time interval altering means alters the set time interval in reference to the table.

3. The image-quality stabilizer as set forth in claim 1, wherein:

said time interval altering means includes a table showing time intervals, a time interval being set so as to be altered based on a difference between the detected adhering toner amount and the predetermined reference toner amount and also based on a number of times the feedback control having been executed, and said time interval altering means alters the set time interval in reference to the table.

4. The image-quality stabilizer as set forth in claim 2, further comprising:

time interval reducing means for setting a shorter time interval based on the table when a difference between the detected adhering toner amount and the predetermined reference toner amount after executing the feedback control is above a predetermined value.

5. An image-quality stabilizer for use in an electrophotographic printing machine, comprising:

adhering toner amount detecting means for detecting respective adhering toner amounts of a plurality of reference toner images formed on a photoreceptor based on respective outputs from charger means;

time measuring means for measuring a set time interval between feedback controls;

time interval altering means for altering the set time interval based on a difference between a detected adhering toner amount and a predetermined reference toner amount at a start of every feedback control; and control means for executing the feedback control on an output from said charger means based on an altered time interval so that the detected adhering toner amount becomes equal to the predetermined reference toner amount.

6. An image-quality stabilizer for use in an electrophotographic printing machine:

charger output detecting means for detecting an output from charger means;

time measuring means for measuring a set time interval between feedback controls;

time interval altering means for altering the set time interval based on a difference between a charger output at a start of the feedback control and a charger output at an end of the feedback control;

control means for executing the feedback control on an output from said charger means based on an altered time interval so that the charger output at the start of the feedback control becomes equal to the charger output at the end of the feedback control.

7. The image-quality stabilizer as set forth in claim 6, wherein:

said time interval altering means includes a table showing time intervals, a time interval being set so as to be altered based on a difference between the charger output at the start of the feedback control and the charger output at the end of the feedback control, and said time interval altering means alters the set time interval in reference to the table.

8. The image-quality stabilizer as set forth in claim 7, wherein:

time interval reducing means for setting a shorter time interval based on the table when a difference between the charger output at the start of the feedback control and the charger output at the end of the feedback control is above a predetermined value.

* * * * *